US005725206A

United States Patent [19]

Sugiyama

[11] Patent Number: 5,725,206

[45] Date of Patent: Mar. 10, 1998

[54] SHEET FEEDING APPARATUS

[75] Inventor: Noriyuki Sugiyama, Kawasaki, Japan

[73] Assignee: Canon Kabushiki Kaisha

[21] Appl. No.: 420,214

[22] Filed: Apr. 11, 1995

[30] Foreign Application Priority Data

Apr. 13, 1994 [JP] Japan ..... 6-074813
Mar. 30, 1995 [JP] Japan ..... 7-073337

[51] Int. Cl.[6] ..... B65H 11/00

[52] U.S. Cl. ..... 271/9.09; 347/4

[58] Field of Search ..... 271/9.09, 10.09, 271/10.11, 113, 121; 347/4

[56] References Cited

U.S. PATENT DOCUMENTS 4,790,524 12/1988 Murakami et al. ..... 271/9.09
5,222,722 6/1993 Kamano ..... 271/9.09
5,290,021 3/1994 Murooka et al. ..... 271/9.09

FOREIGN PATENT DOCUMENTS 4221903 2/1993 Germany ..... 271/9.09
67431 8/1982 Japan ..... 271/9.09
6540 1/1985 Japan ..... 271/9.09
232631 10/1991 Japan ..... 271/9.09

*Primary Examiner*—Frank E. Werner
*Attorney, Agent, or Firm*—Fitzpatrick, Cella, Harper & Scinto

[57] ABSTRACT

A sheet feeding apparatus has an automatic sheet supply mode in which a sheet is fed from sheet supporting devices supporting a sheet stack thereon to sheet conveying devices disposed downstream thereof by sheet feeding devices, and a manual mode in which a manual sheet is abutted against the sheet conveying devices and supplied. The sheet fed by the sheet feeding devices is operated also in the manual mode.

10 Claims, 14 Drawing Sheets

| FIG. 13A | FIG. 13B |
|---|---|

| |
|---|
| FIG. 14A |
| FIG. 14B |

SHEET FEEDING APPARATUS

BACKGROUND OF THE INVENTION

1. Field of the Invention

This invention relates to a sheet feeding apparatus for feeding sheets, for example, to a recording apparatus in a printer, copying apparatus, a word processor, a personal computer, a facsimile apparatus or the like, and more particularly to a sheet feeding apparatus for supplying sheets from first and second positions at which the sheets are set by manual insertion or by being stacked, through a single sheet conveying path.

2. Related Background Art

Recording apparatuses in printers, copying apparatuses, word processors, personal computers, facsimile apparatuses or the like have heretofore been provided with sheet feeding apparatuses for feeding sheets such as paper sheets or plastics sheets to a recording portion, a transfer portion, an exposure portion or the like. Some of such sheet feeding apparatuses are provided with a manual feeding portion utilizing one and the same sheet conveying path to set sheets one by one at a first set position whereat the leading end of each sheet is knocked against a pair of conveying rollers by manual insertion, and an automatic feeding portion for stacking a plurality of sheets at a second set position, separating and feeding the sheets one by one to the pair of conveying rollers by a feed roller, and automatically feeding the sheets to the recording portion or the like by the pair of conveying rollers. In the above-described sheet feeding apparatuses, when the sheets set at the first set position are to be manually fed from the manual feeding portion, the driving of the feed roller has not been effected but only the pair of conveying rollers have been driven to thereby convey the sheets to the recording portion or the like.

In the above-described sheet feeding apparatuses according to the prior art, however, when an attempt is made to set a sheet such as an envelope or thick paper at said first set position and convey it by the driving of only the pair of conveying rollers, it is difficult for the envelope or the thick paper to be conveyed by the pair of conveying rollers unless the trailing end of the envelope or the thick paper is manually pushed, because the sticking of the sheet to the nip portion of the pair of conveying rollers is bad, and this has led to the possibility that unsatisfactory feeding will occur. Also, unless the leading end of the sheet sufficiently knocks up against the pair of conveying rollers, the sheet will not be conveyed by the pair of conveying rollers and thus, unsatisfactory feeding has been liable to occur.

SUMMARY OF THE INVENTION

It is the object of the present invention to solve the above-noted problems peculiar to the prior art and to provide a sheet feeding apparatus which, when manual feeding is to be effected, can reliably and easily feed a sheet without causing unsatisfactory feeding even if the sheet is not set with its leading end knocked against conveying means.

The sheet feeding apparatus of the present invention is characterized by an automatic sheet supply mode in which a sheet is fed from sheet supporting means supporting a sheet stack thereon to sheet conveying means disposed downstream thereof by sheet feeding means, and a manual mode in which a manual sheet is knocked against said sheet conveying means and supplied, the sheet being fed by said sheet feeding means being operated also in said manual mode.

Also, the sheet feeding apparatus of the present invention is characterized by sheet supporting means supporting sheets thereon, sheet feeding means for feeding the sheets from said sheet supporting means, sheet conveying means for conveying the sheets separated by separating means, mode changeover means for changing over an automatic sheet supply mode in which sheets stacked at a predetermined distance downstream of said sheet conveying means are fed toward said sheet conveying means by said sheet feeding means and a manual mode in which the sheets are knocked against said sheet conveying means and conveyed, and control means for rendering said sheet conveying means operable when the mode is changed over to the manual mode by said mode changeover means.

DETAILED DESCRIPTION OF THE PREFERRED EMBODIMENTS

Figure 1:
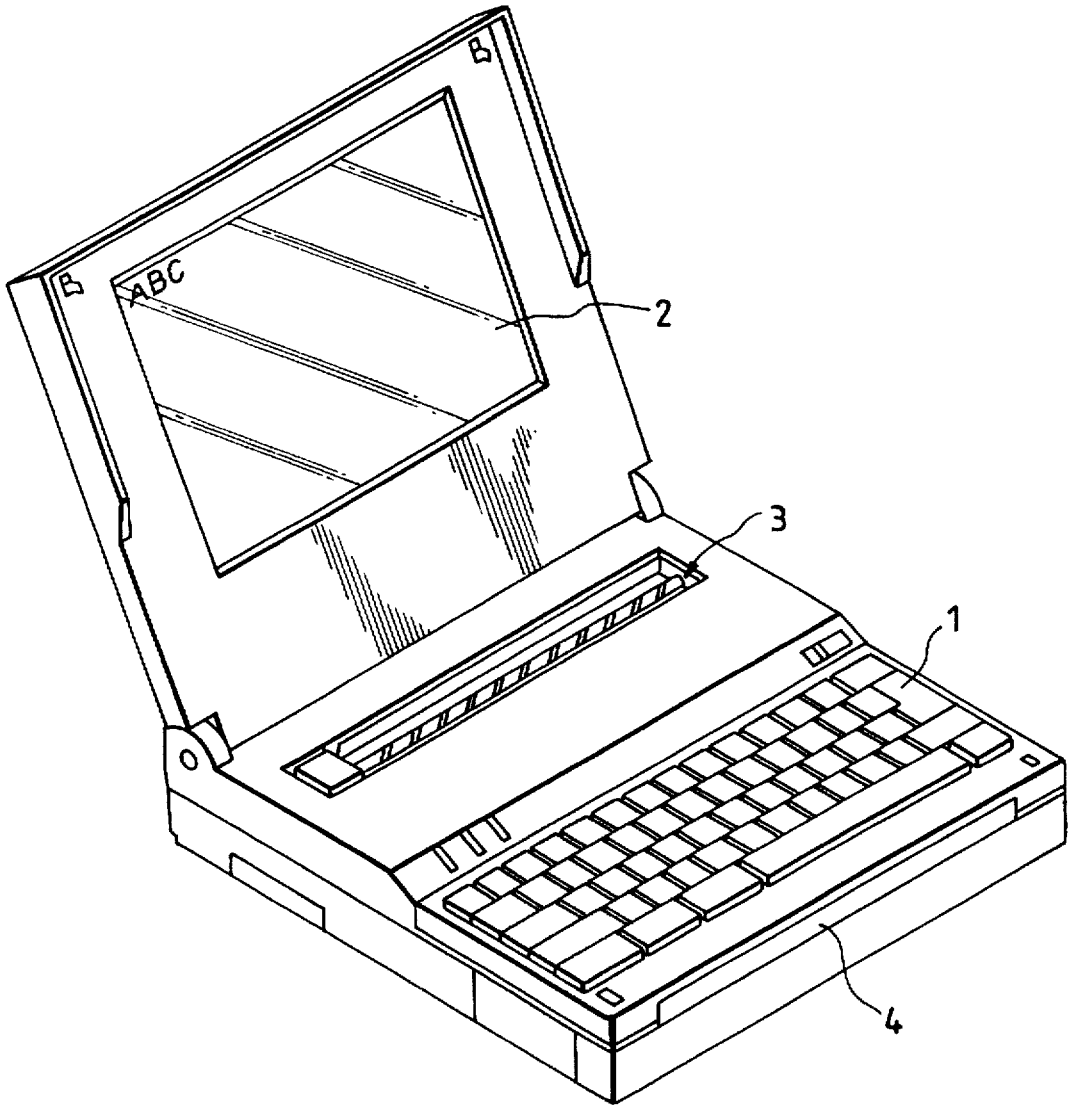
FIG. 1 is a perspective view of a personal computer provided with the sheet feeding apparatus of the present invention.

An embodiment of a sheet feeding apparatus according to the present invention will hereinafter be described with reference to the drawings. In this embodiment, an ink jet printer provided in a personal computer is used as a recording apparatus, and description will be made of a sheet feeding apparatus for feeding sheets to the ink jet printer. The outer construction of the personal computer will first be described with reference to FIGS. 1 and 2.

Figure 2:
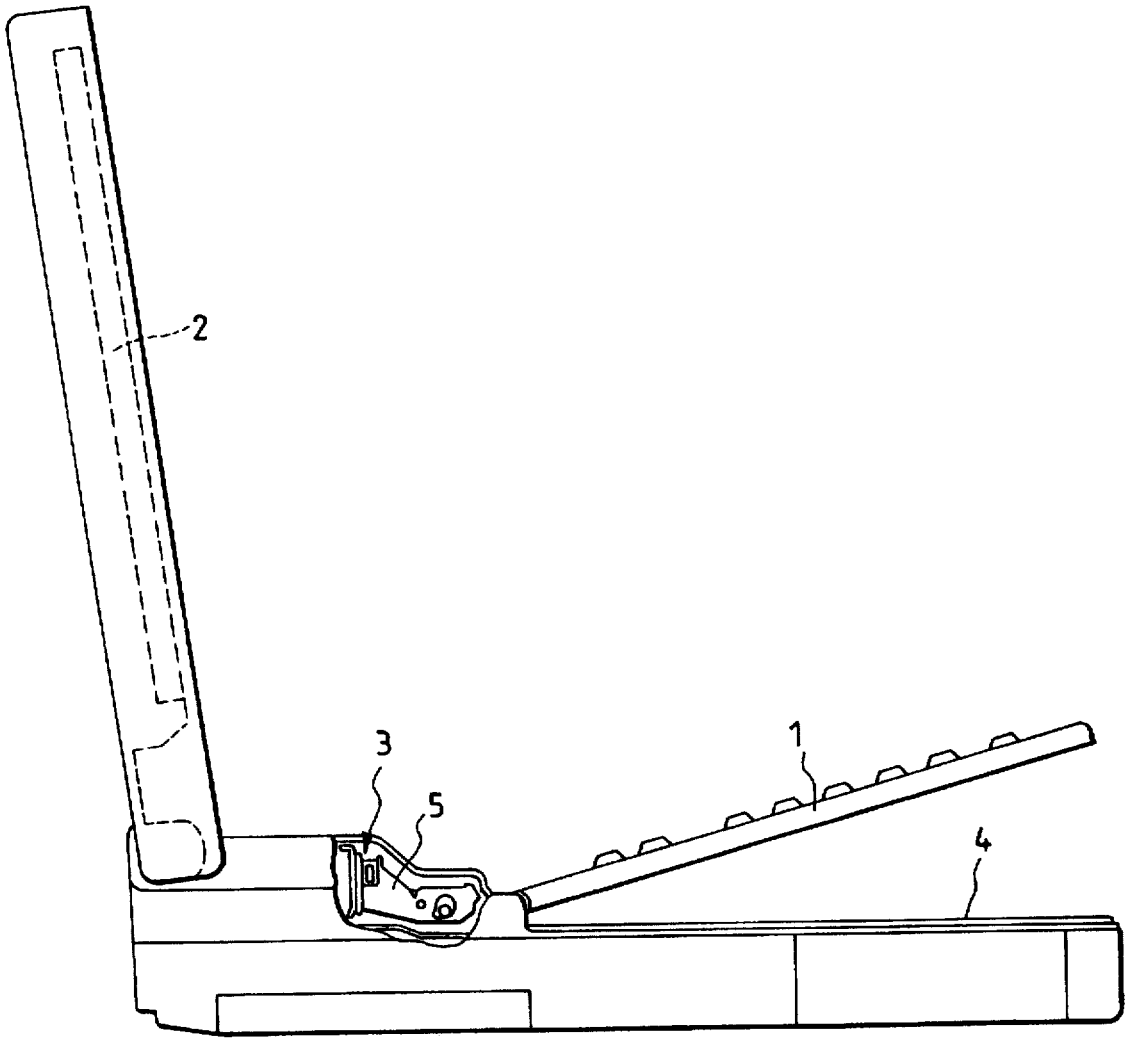
FIG. 2 is a side view of the personal computer shown in FIG. 1.

The reference numeral 1 designates a keyboard provided with keys for inputting information suck as characters, figures and other characters and keys for giving various commands, the reference numeral 2 denotes a displaying portion comprised chiefly of liquid crystal, etc. for displaying the information, the reference numeral 3 designates a conventional recording apparatus (ink jet printer) for effecting recording on a sheet P such as supplied recording paper or plastic sheet in conformity with image information, and the reference numeral 4 denotes a feeding guide for supplying the sheet P to the ink jet printer 3. The sheet P can be supplied along the feeding guide 4 to a single sheet conveying path formed by the keyboard 1 being upwardly rotatively moved as shown in FIG. 2. Also, as shown in FIG. 2, an automatic sheet feeding portion 5 for automatically feeding the sheet P supplied along the feeding guide 4 is connected to the ink jet printer 3.

The construction of the ink jet printer 3 will now be described with reference to FIG. 3.

Figure 3:
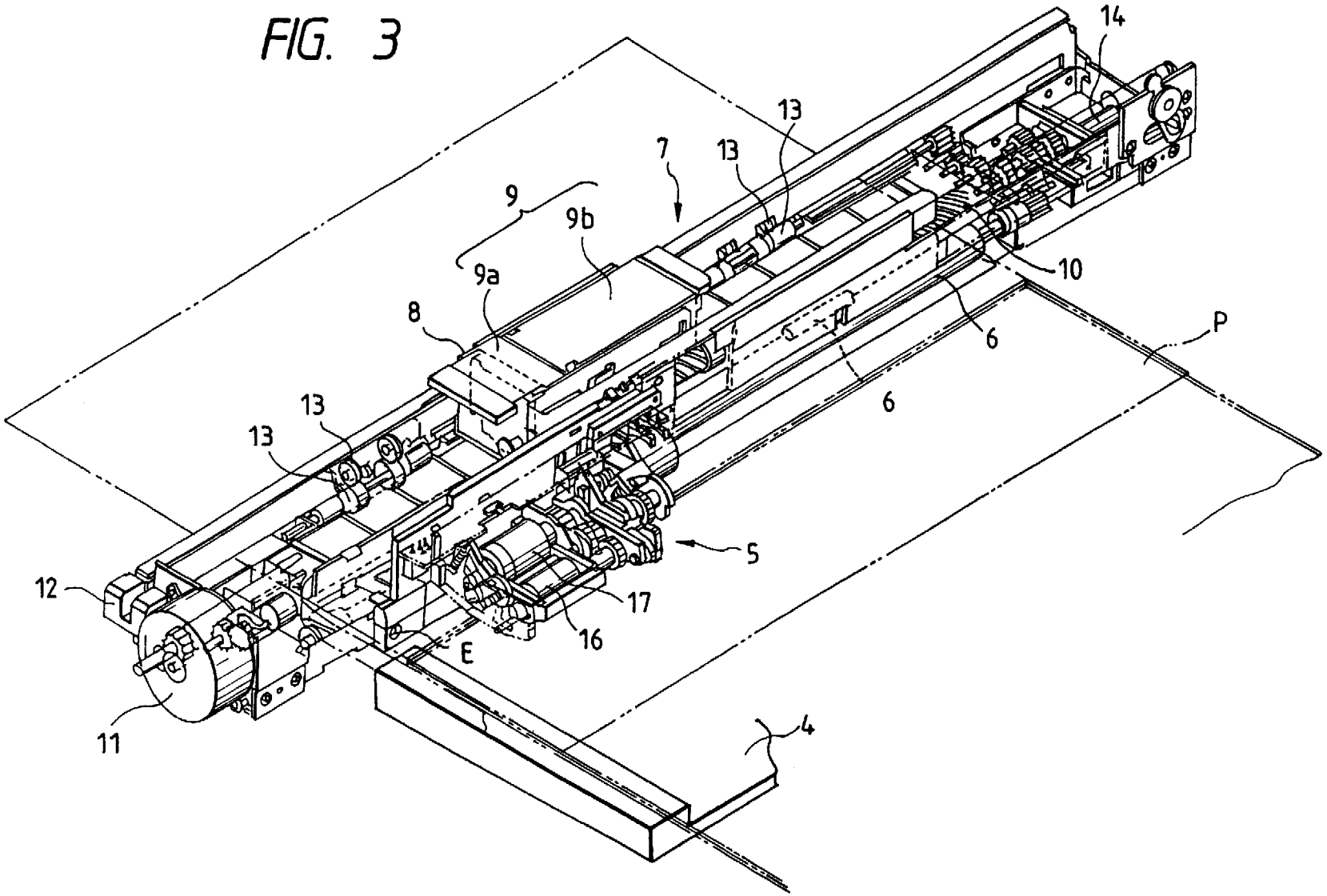
FIG. 3 is a perspective view of an ink jet printer carried on the personal computer shown in FIG. 1.

In FIG. 3, the reference numeral 6 designates a pair of conveying rollers (conveying means) for conveying the sheet P supplied by the automatic sheet feeding portion 5 or by manual insertion to a recording portion 7. The recording portion 7 is for effecting recording on the sheet P conveyed by the pair of conveying rollers 6. A carrier 8 is movably provided in this recording portion 7, and a head cartridge 9 as recording means is carried on the carrier 8. This head cartridge 9 comprises a recording head **9*a* and an ink tank 9*b* made integral with each other, and is for recording an ink image on the sheet P conveyed by the pair of conveying rollers 6. As recording means, use is made of an ink jet recording system which discharges ink from the recording head 9*a*** and thereby effects recording. That is, this recording head is provided with a minute liquid discharge port (orifice), a liquid path, an energy acting portion provided in a portion of the liquid path, and energy generating means for generating liquid droplet forming energy to be caused to act on liquid in the energy acting portion.

For the energy generating means, use may be made of a recording method using an electro-mechanical converting member such as a piezo element, a recording method using energy generating means for applying an electromagnetic wave such as a laser to thereby generate heat, and causing liquid droplets to be discharged by the action of the generated heat, or a recording method using energy generating means for heating liquid by an electro-thermal converting member such as a heat generating element having a heat generating resistor and causing the liquid to be discharged. Among these methods, a recording head used in the ink let recording method of discharging liquid by heat energy permits liquid discharge ports (orifices) for discharging liquid droplets for recording to thereby form liquid droplets to be discharged to be arranged highly densely and can therefore accomplish recording of high resolution. Above all, a recording head using an electro-thermal converting member as energy generating means is easy to make compact and is advantageous in that it can sufficiently make the most of the advance of technology in the latent field of semiconductors and the merits of the IC technique and micro-processing technique remarkably improved in reliability and easily permits highly dense packaging and is low in manufacturing cost.

The carrier 8 is connected to a lead screw 10, which rotatively drives a carrier motor 11 in forward and reverse directions to thereby transmit the drive and reciprocally move the carrier 8 in the axial direction thereof. The detection of the recording waiting position (home position) of the carrier 8 is effected by a home position sensor 12 provided at one end (the left end as viewed in FIG. 3) of the range of movement thereof.

The reference numeral 13 denotes a pair of discharge rollers for discharging the sheet P after recording out of the apparatus. When the recording of one line is terminated by the scanning of the carrier 8, the sheet P is conveyed by an amount corresponding to one line by the pair of conveying rollers 6, and the pair of conveying rollers 6 and the pair of discharge rollers 13 have transmitted thereto a drive force by a sheet feeding motor 14. The letter E designates a paper sensor for detecting the presence or absence of a sheet supplied to the pair of conveying rollers 6, i.e., the presence or absence of sheets P stacked on the feeding guide 4.

The construction of the sheet feeding apparatus will now be described with reference to FIGS. 4 to 8.

As shown in FIG. 3, the sheet P is set at a first set position whereat it is singly set on the feeding guide 4 by manual insertion so that the leading end thereof is knocked against the nip between the pair of conveying rollers 6, or at a second set position whereat a plurality of sheets are stacked on the automatic sheet feeding portion 5 provided upstream of the first set position with respect to the direction of sheet conveyance with their leading ends made uniform, and is supplied to the recording portion 7 through a common sheet conveying path.

The construction of the automatic sheet feeding portion 5 will now be described with reference to FIG. 4. The reference numeral 15 denotes a sheet stopper as sheet regulating means for effecting the positioning of the sheet P with its leading end portion knocked against the sheet stopper. This sheet stopper 15 prescribes the second set position at which the sheets P are stacked when the automatic feeding of the sheets P is to be effected. The sheet stopper 15 is vertically pivoted by a sheet stopper up cam 21 which will be described later, and protrudes into and retracts from the sheet conveying path. The reference numeral 16 designates a preliminary roller as a preliminary conveying rotatable member for preliminarily conveying the sheets P stacked at the second set position to a separating portion. The reference numeral 17 denotes a separation roller as a separating rotatable member for separating and conveying only the uppermost sheet P while holding it between itself and a separation pad **4*b***.

Figure 5:
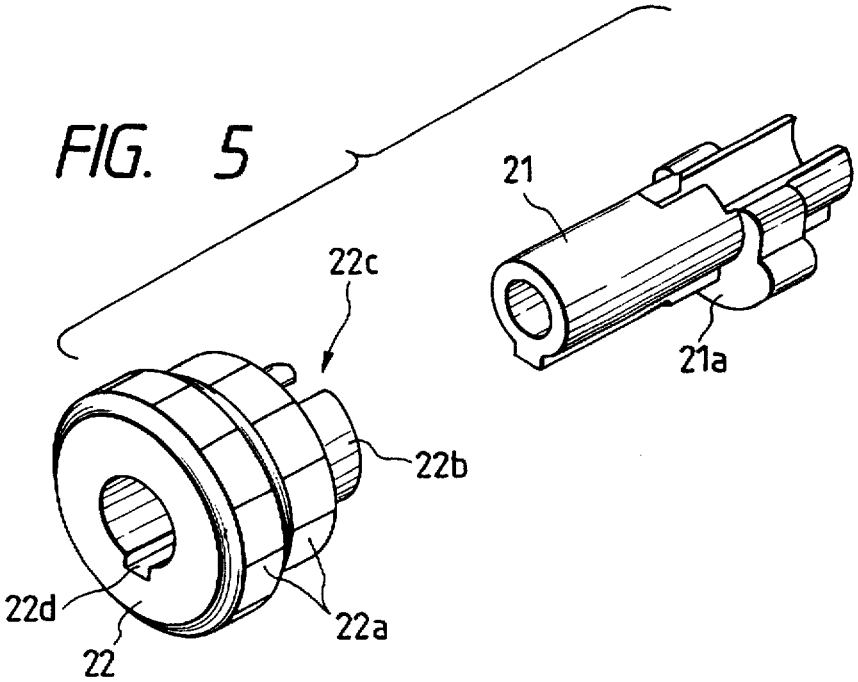
FIG. 5 is an exploded perspective view showing the constructions of a cam gear and a sheet stopper up cam, in the automatic sheet supply portion of the sheet feeding device shown in FIG. 4.

The reference numeral 18 designates an automatic sheet supply motor as a drive source which transmits a drive force to the preliminary roller 16 and the separation roller 17. The drive force of this automatic sheet supply motor 18 is transmitted to the preliminary roller 16 and the separation roller 17 through a two-stage gear 19, an output gear 20, the sheet stopper up cam 21 and a cam gear 22. The cam gear 22, as shown in FIG. 5, is provided with a gear portion **22*a* contributing to the transmission of the drive force of the automatic sheet supply motor 18, and in addition, a home position detecting cam portion 22*b* for transmitting to a sheet supply initial sensor 24 information which is the basis of the home position of the automatic sheet feeding portion 5 through an initial lever 23, a home position detecting groove 22*c* and an engagement hole 22*d* engaged by the sheet stopper up cam 21**.

A stepping motor is used as the automatic sheet supply motor 18, and is bipolar-driven by two-phase excitation and makes a round by 20 steps. Also, the total ratio of the speed reduction from the automatic sheet supply motor 18 to the cam gear 22 is set to 1:256. Further, design is made such that the preliminary roller 16 and separation roller 17 each make one full rotation for one full rotation of the cam gear 22.

Figure 4:
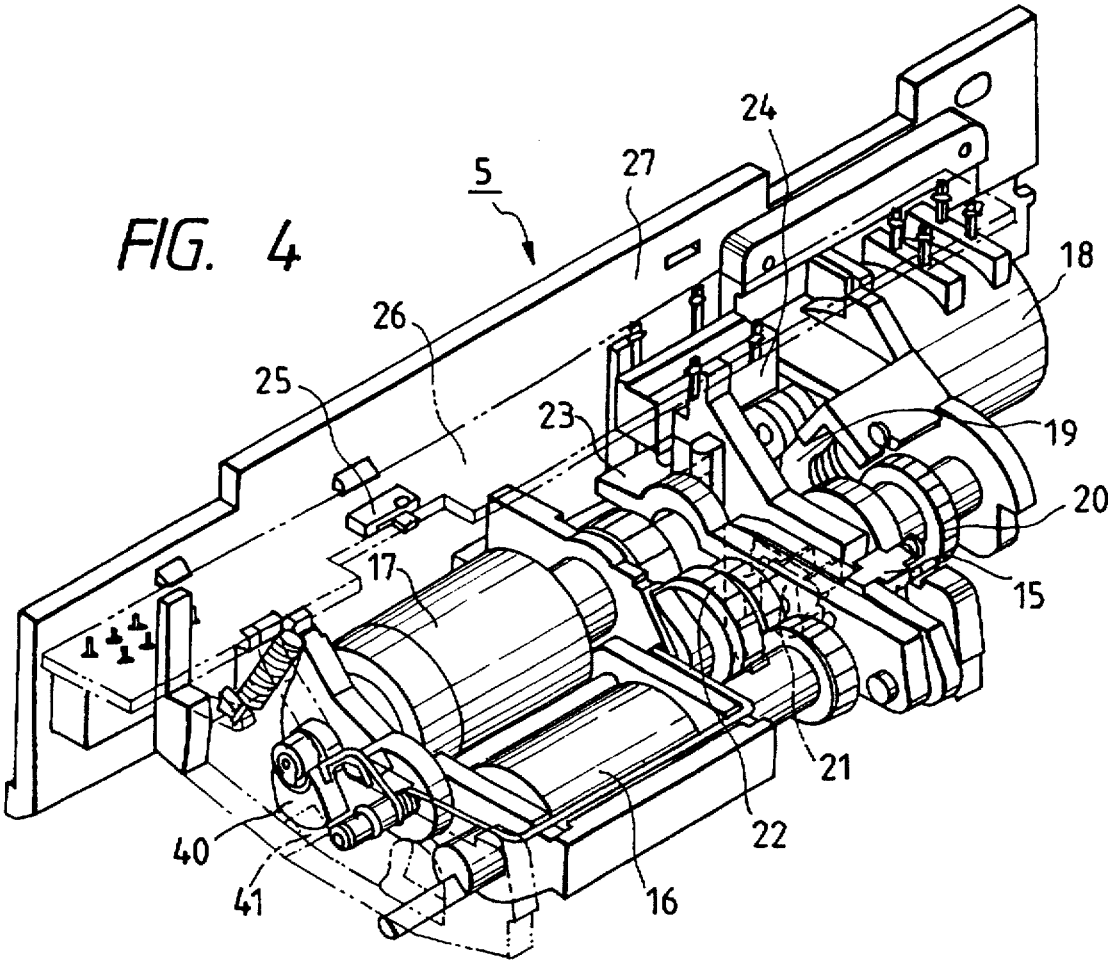
FIG. 4 is a perspective view of the sheet feeding apparatus connected to the ink jet printer shown in FIG. 3.

In FIG. 4, the reference numeral 25 designates a sheet supply change switch for changing over the state of the sheet feeding apparatus to an automatic sheet supply state in which the automatic sheet feeding portion 5 is used and a manual insertion sheet supply state in which the automatic sheet feeding portion 5 is not used. The reference numeral 26 denotes a base plate on which the sheet supply change switch 25, the sheet supply initial sensor 24 and other electronic parts are provided. This base plate 26 is supported by a main holder 27, which supports all of the parts of the automatic sheet feeding portion 5 and is fixed to the recording portion 7.

The preliminary roller 16, as shown in FIGS. 9A–9D, is a roller having a portion of its outer peripheral surface cut away, and when the cut-away portion becomes opposed to the feeding guide 4, a gap into which a sheet is inserted is formed between the preliminary roller 16 and the feeding guide 4. When the preliminary roller 16 makes one full rotation, its circumferential surface slidably contacts with the upper surface of the sheet inserted in the gap and feeds out the sheet by a predetermined amount.

Figure 6:
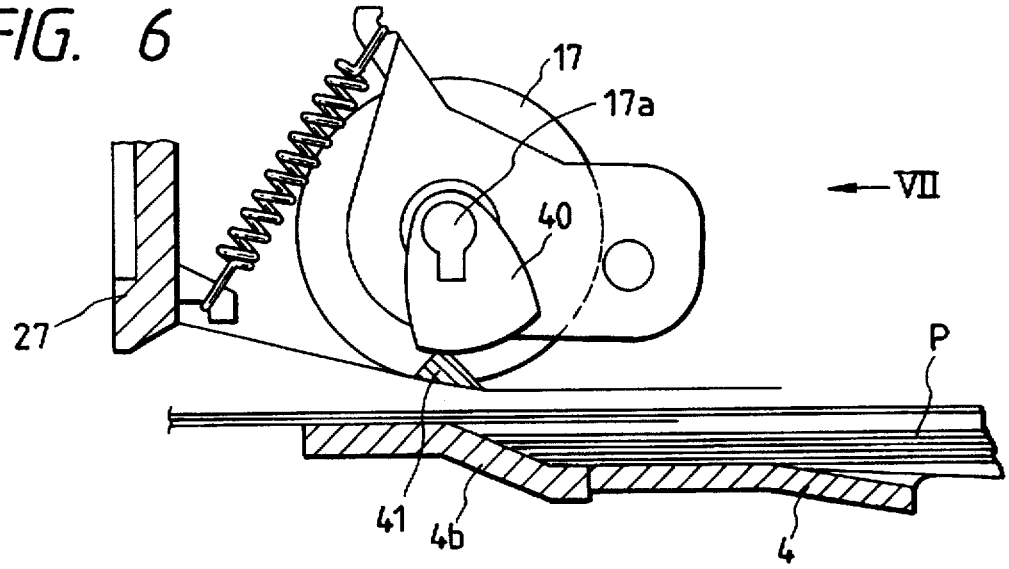
FIG. 6 is a side view showing the separation roller of the sheet feeding apparatus shown in FIG. 4.
Figure 7:
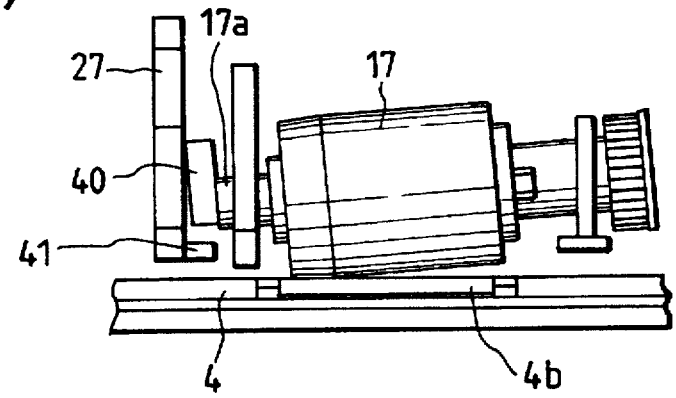
FIG. 7 is a front view showing the separation roller of the sheet feeding apparatus shown in FIG. 4.

As shown in FIGS. 6 and 7, the separation roller 17 is a cylindrical roller mounted on a separation roller shaft 17*a* pivotally provided. A separation roller cam 40 rotatable with the separation roller 17 is mounted on one end portion of the separation roller shaft 17*a*. A cam receiving portion 41 is provided on that location on the main holder 27 which corresponds to the separation roller cam 40, and the separation roller cam 40 can slidably contacts with the cam receiving portion 41.

When as shown in FIG. 6, the separation roller cam 40 is in slidable contact with the cam receiving portion 41, the separation roller shaft 17*a* is raised and the separation roller 17 is positioned upwardly, whereby a gap is formed between the separation roller and the separation pad 4*b*. Also, when as shown in FIG. 7, the separation roller cam 40 is spaced apart from the cam receiving portion 41, the separation roller shaft 17*a* is inclined and the separation roller 17 lowers and comes into slidable contact with the separation pad 4*b*. If at this time, sheets are fed into the gap between the separation roller 17 and the separation pad 4*b* by the preliminary roller 16, the sheets will be separated one by one therebetween and fed to the downstream side.

The sheet feeding operation of the automatic sheet feeding portion 5 will now be roughly described with reference to FIGS. 11A–11J. FIGS. 11A–11E show the states of the sheet stopper 15, and FIGS. 11F–11J show the states of the preliminary roller 16 and the separation roller 17 divisionally (the positioning portion 15*a* of the sheet stopper 15 lies on a line X in FIG. 11F).

Figure 11A:
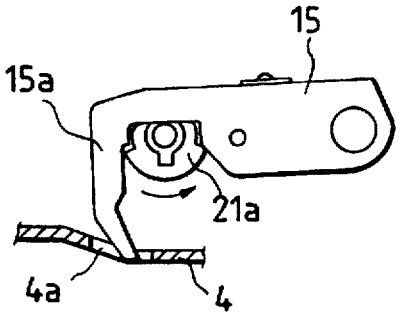
FIGS. 11A–11J show one cycle of the sheet supplying operation of the sheet feeding apparatus shown in FIG. 4.
Figure 11B:
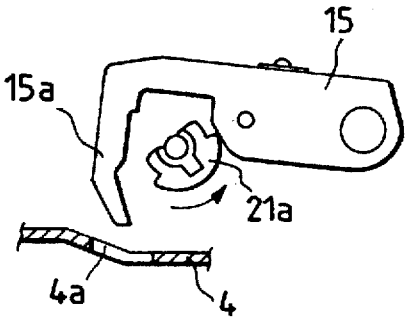
Figure 11C:
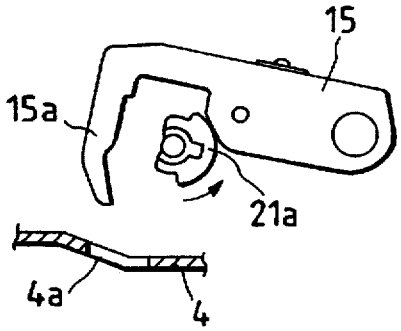
Figure 11D:
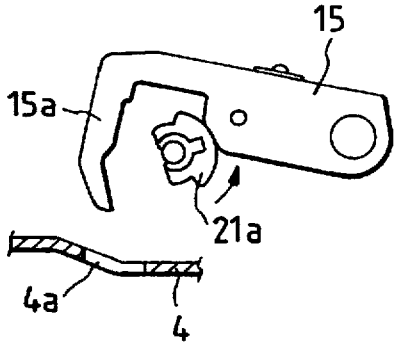
Figure 11E:
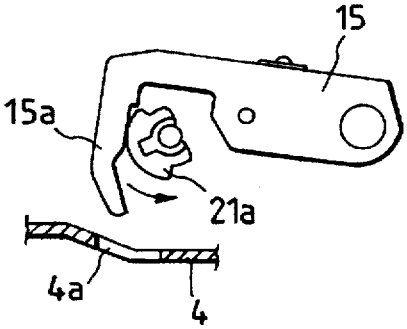
Figure 11F:
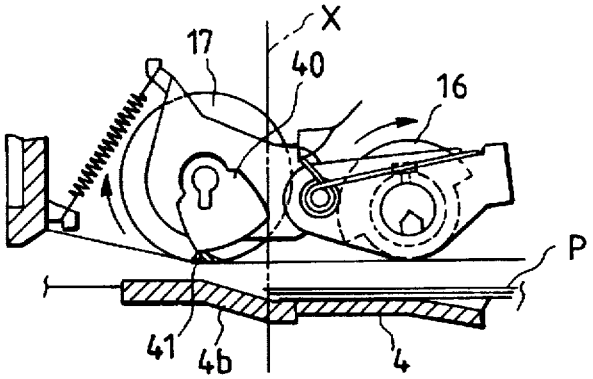
Figure 11G:
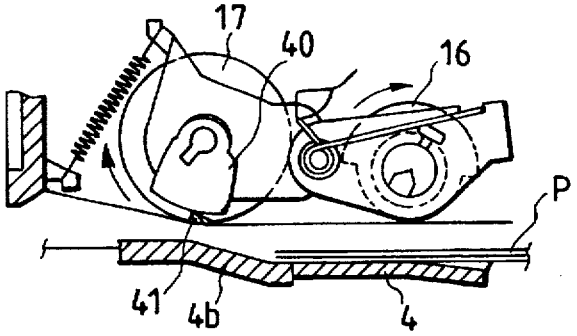
Figure 11H:
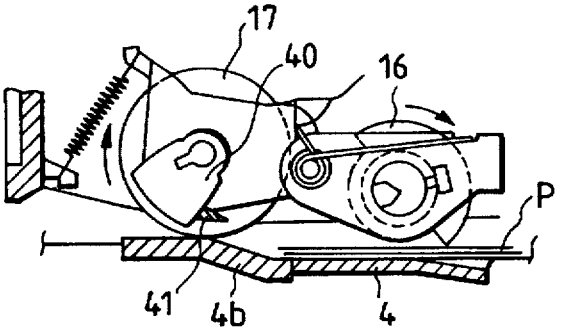
Figure 11I:
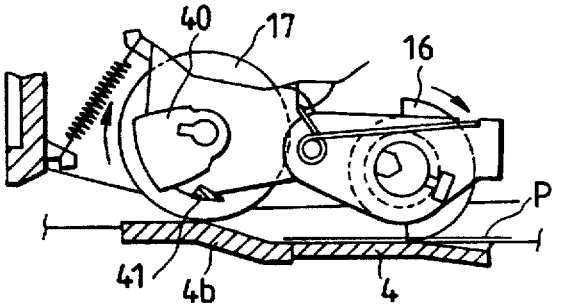
Figure 11J:
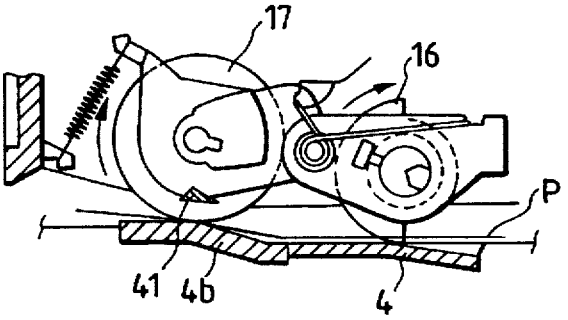

The states of the respective members when the automatic sheet supply motor 18 makes one full rotation during automatic sheet supply are successively shown in FIGS. 11A–11E and FIGS. 11F–11J. In FIGS. 11A and 11F, a sheet is inserted onto the feeding guide 4 and its leading end is regulated by the sheet stopper 15. As shown in FIGS. 11B and 11G, when the automatic sheet supply motor 18 makes one full rotation, the sheet stopper 15 is moved up to thereby release its regulation for the sheets. Thereafter, as shown in FIGS. 11C and 11H, the separation roller 17 first comes into slidable contact with the separation pad 4*b*, whereafter the outer peripheral surface of the preliminary roller 16 comes into slidable contact with the upper surface of the sheets, thereby feeding out the sheet. The sheets thus fed out are separated one by one between the separation roller 17 and the separation pad 4*b* and fed toward the pair of conveying rollers 6 (shown in FIGS. 11D, 11I; 11E, 11J.)

In the present apparatus, in order to achieve the compactness of the apparatus, the diameter of the separation roller 17 is set to a small value and the Mount by which the sheet is conveyed is small and therefore, the sheet is fed out by two full rotations at least, i.e., two cycles of the operation of FIGS. 11A–11E; 11F–11J. As will be described later, design is made such that if the sheet fed out does not arrive at the paper sensor E even when the separation roller is caused to make four full rotations, it will be judged that jam has occurred and the sheet supplying operation will be stopped.

The home position detecting method in the automatic sheet feeding operation of the above-described automatic sheet feeding portion 5 will now be described with reference to FIG. 8.

Figure 8:
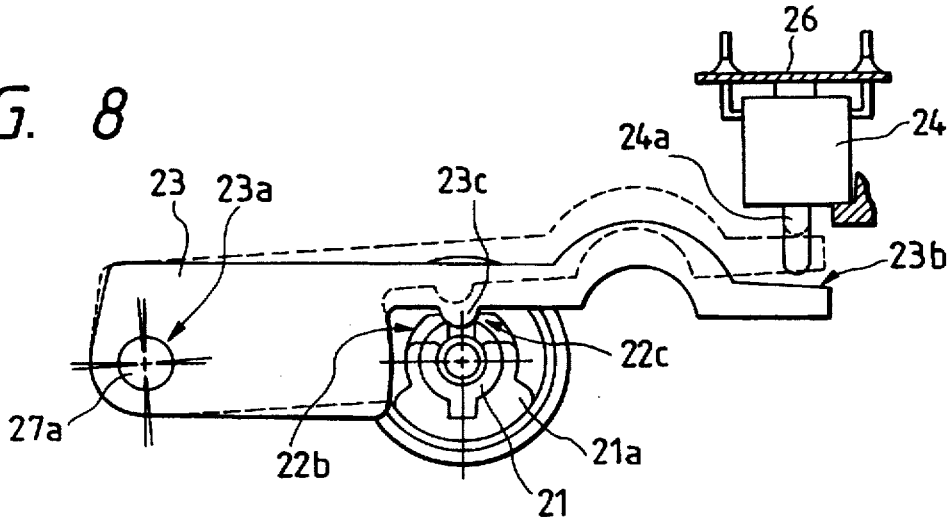
FIG. 8 shows the construction of a home position detecting portion during the sheet supply by the sheet feeding apparatus shown in FIG. 4.

In FIG. 8, the cam gear 22 has a home position detecting cam portion 22*b* engaged with the sheet stopper up cam 21 and provided adjacent to the cam portion 21*a* of the sheet stopper up cam 21. Also, as shown in FIG. 8, an initial lever 23 at its center of rotation 23*a* is rotatably engaged with the rotational center shaft 27*a* of the main holder 27. A plate-like acting portion 23*b* for pushing the actuator portion 24*a* of the sheet supply initial sensor 24 provided on the base plate 26 is provided on the side opposite to the rotational center shaft 23*a* of the initial lever 23 and further, a follower portion 23*c* adapted to bear against the home position detecting cam portion 22*b* and slide is provided between the center of rotation 23*a* and the acting portion 23*b*.

In the above-described construction, when as indicated by solid line in FIG. 8, the follower portion 23*c* of the initial lever 23 falls in the home position detecting groove 22*c* of the cam gear 22, the acting portion 23*b* is spaced apart from the actuator portion 24*a* and at this time, the initial sensor 24 is in its ON state. Also, when an indicated by broken line in FIG. 8, the cam gear 22 has rotated and the follower portion 23*c* of the sheet supply initial lever 23 bears against the outer periphery of the home position detecting cam portion 22*b*, the acting portion 23*b* pushes down the actuator portion 24*a* and at this time, the sheet supply initial sensor 24 is in its OFF state. A state in which the driving of the automatic sheet feeding portion 5 has been stopped about in the course until the signal of the sheet supply initial sensor 24 changes from ON to OFF is shown in FIGS. 9A–9D, and this state is the sheet supply waiting position (home position) in an automatic sheet supply state.

Figure 9A:
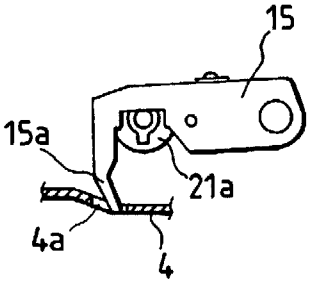
FIGS. 9A–9D show the automatic sheet supply waiting state of the sheet feeding apparatus shown in FIG. 4.
Figure 9B:
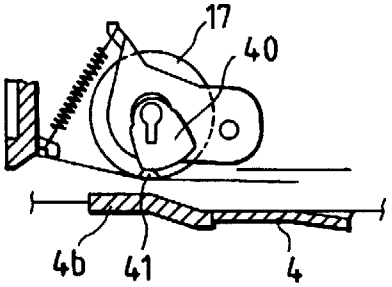
Figure 9C:
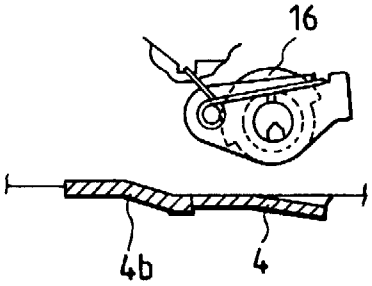
Figure 9D:
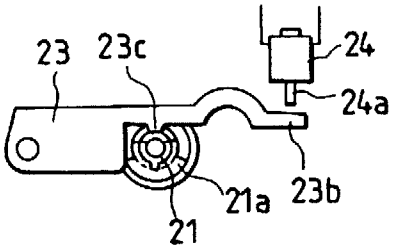

The home position in the automatic sheet supply state and manual insertion sheet supply state of the automatic sheet feeding portion 5 will now be described with reference to FIGS. 9A–9D and FIGS. 10A–10D. FIGS. 9A–9D and FIGS. 10A–10D show the states of the sheet stopper 15, the separation roller 17, the preliminary roller 16 and the initial lever 23, respectively. First, the home position in the automatic sheet supply state is such that as shown in FIG. 9D, the follower portion 23*c* of the initial lever 23 falls in the home position detecting groove 22*c* of the cam gear 22 and the sheet supply initial sensor 24 is in its ON state. At this time, as shown in FIGS. 9B and 9C, a sheet conveying path is formed between the preliminary roller 16 and the feeding guide 4 and between the separation roller 17 and the feeding guide 4 and also, as shown in FIG. 9A, the tip end of the positioning portion 15*a* of the sheet stopper 15 is inserted in the hole portion 4*a* of the feeding guide 4 opposed thereto, and the stacked sheets P can be set at the second set position with their leading ends knocked against the positioning portion 15*a* protruding into the sheet conveying path.

Figure 10A:
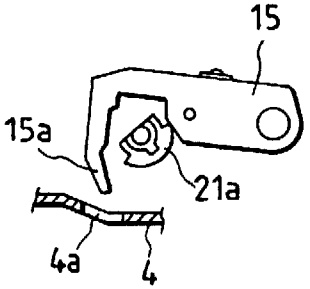
FIGS. 10A–10D show the manual insertion sheet supply waiting state of the sheet feeding apparatus shown in FIG. 4.
Figure 10B:
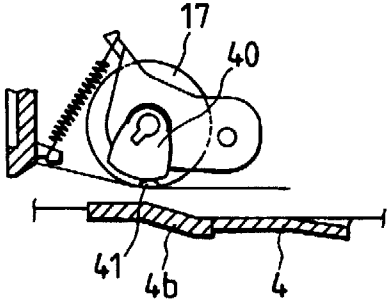
Figure 10C:
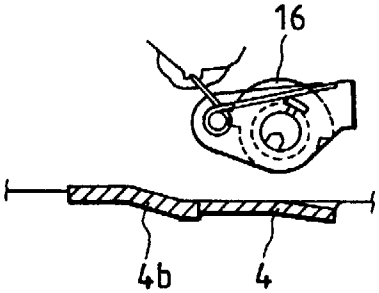
Figure 10D:
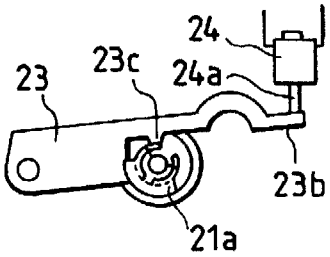

Next, the home position in the manual insertion sheet supply state is such that as shown in FIG. 10D, the cam gear 22 has rotated by about 30° in a clockwise direction from the state shown in FIG. 9D and at this time, the follower portion 23c of the initial lever 23 bears against the outer periphery of the home position detecting cam 22b and the sheet supply initial sensor 24 is in its OFF state. Also, at this time, as shown in FIGS. 10B and 10C, a sheet conveying path is formed between the preliminary roller 16 and the feeding guide 4 and between the separation roller 17 and the feeding guide 4 and also, as shown in FIG. 10A, the tip end of the positioning portion 15a of the sheet stopper 15 comes out of the hole portion 4a of the feeding guide 4 opposed thereto and the positioning portion 15a retracts from the sheet conveying path and therefore, the sheets P can be further brought toward the downstream side by manual insertion and be set at the first set position with their leading ends knocked against the nip portion of the pair of conveying rollers 6.

Figure 12:
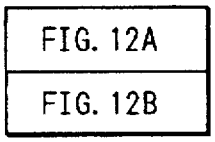
FIG. 12 is comprised of FIGS. 12A and 12B showing block diagrams the construction of the control means of the personal computer shown in FIG. 1.
Figure 12A:
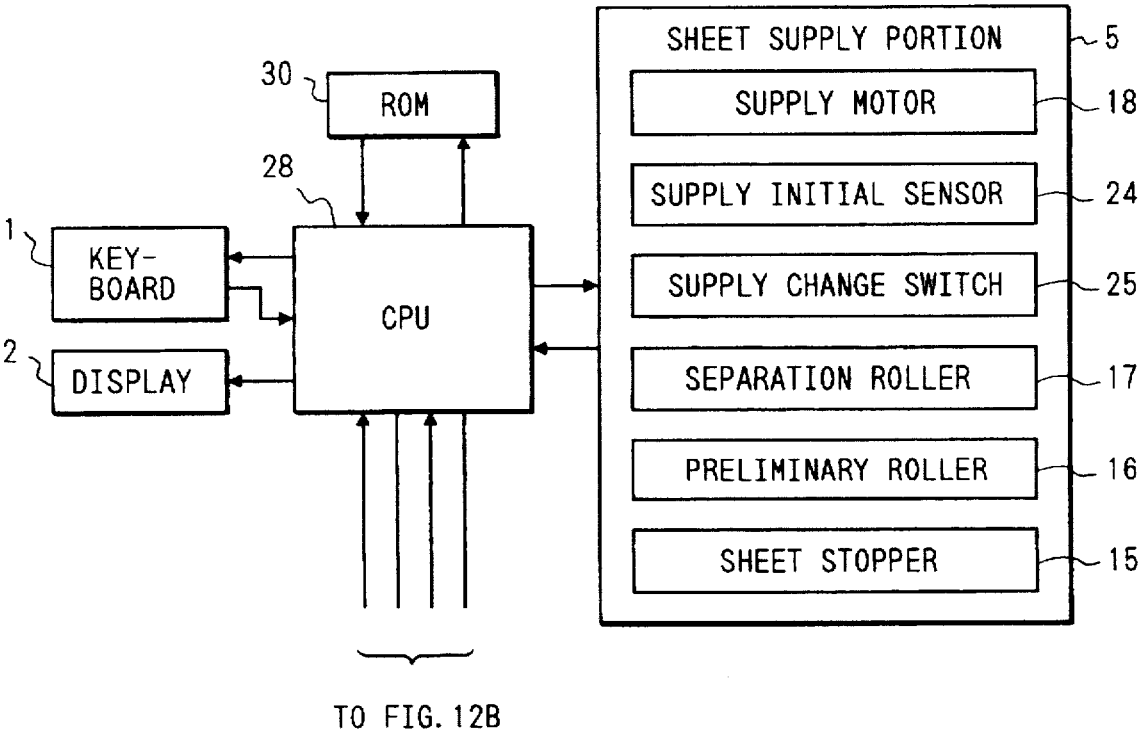
Figure 12B:
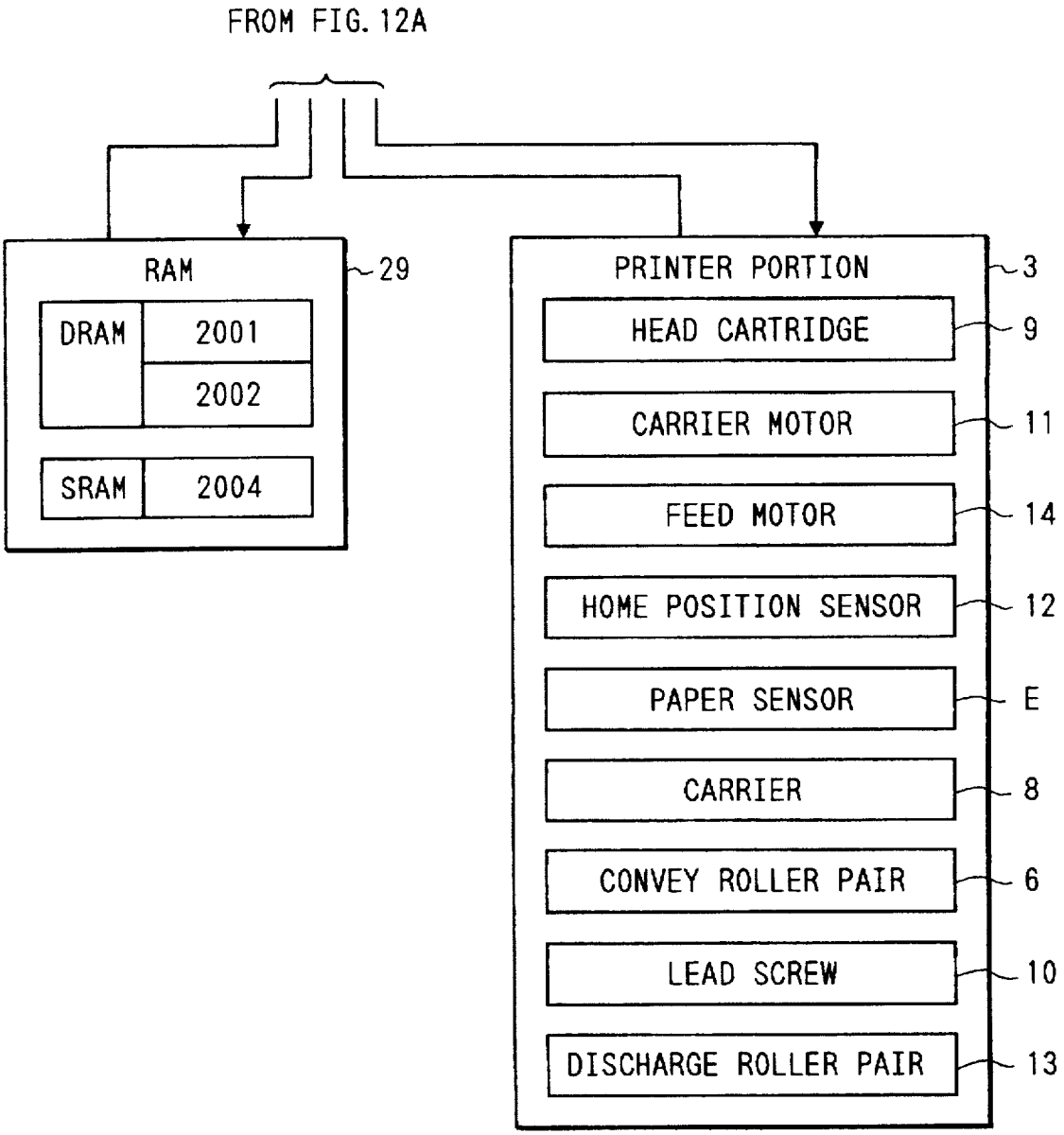

The construction of control means for controlling the driving of the sheet feeding apparatus and the ink jet printer will now be described with reference to a block diagram shown in FIG. 12. In FIG. 12, the reference numeral 28 designates a CPU (central processing unit) which reads out a program and various data from an ROM 30 which will be described later, a floppy disc driver (not shown), etc. and effects necessary calculation and judgment to thereby control various portions.

The reference numeral 29 denotes an RAM (read write memory) having a working area for temporarily storing therein data and result of calculation while the CPU 28 is commanding, a buffer area for storing therein various data inputted from the keyboard 1, an outside interface, etc., and a text area for preserving documents therein. The RAM 29 is comprised of SRAM for holding stored substances by back-up means such as a lithium battery still after the opening of a power source switch, and DRAM from which the stored substances are erased after the opening of the power source switch. The DRAM is provided with an initial step storing area 2001 used during the driving operation of the automatic sheet feeding portion 5, a number of rotation storing area 2002, etc. (when the power source switch is changed over from its OFF position to its ON position, the value in the storing area of the DRAM is initially set to zero), and the SRAM is provided with an operation completion storing area 2004, etc.

The reference numeral 30 designates an ROM (read only memory) storing therein various programs for the CPU 28 to operate and various data necessary for recording such as font data including character codes and dot patterns. The keyboard 1, the displaying portion 2, the ink jet printer 3, the automatic sheet feeding portion 5, etc. are connected to the CPU 28 through an interface (not shown).

Figures 13, 13A:
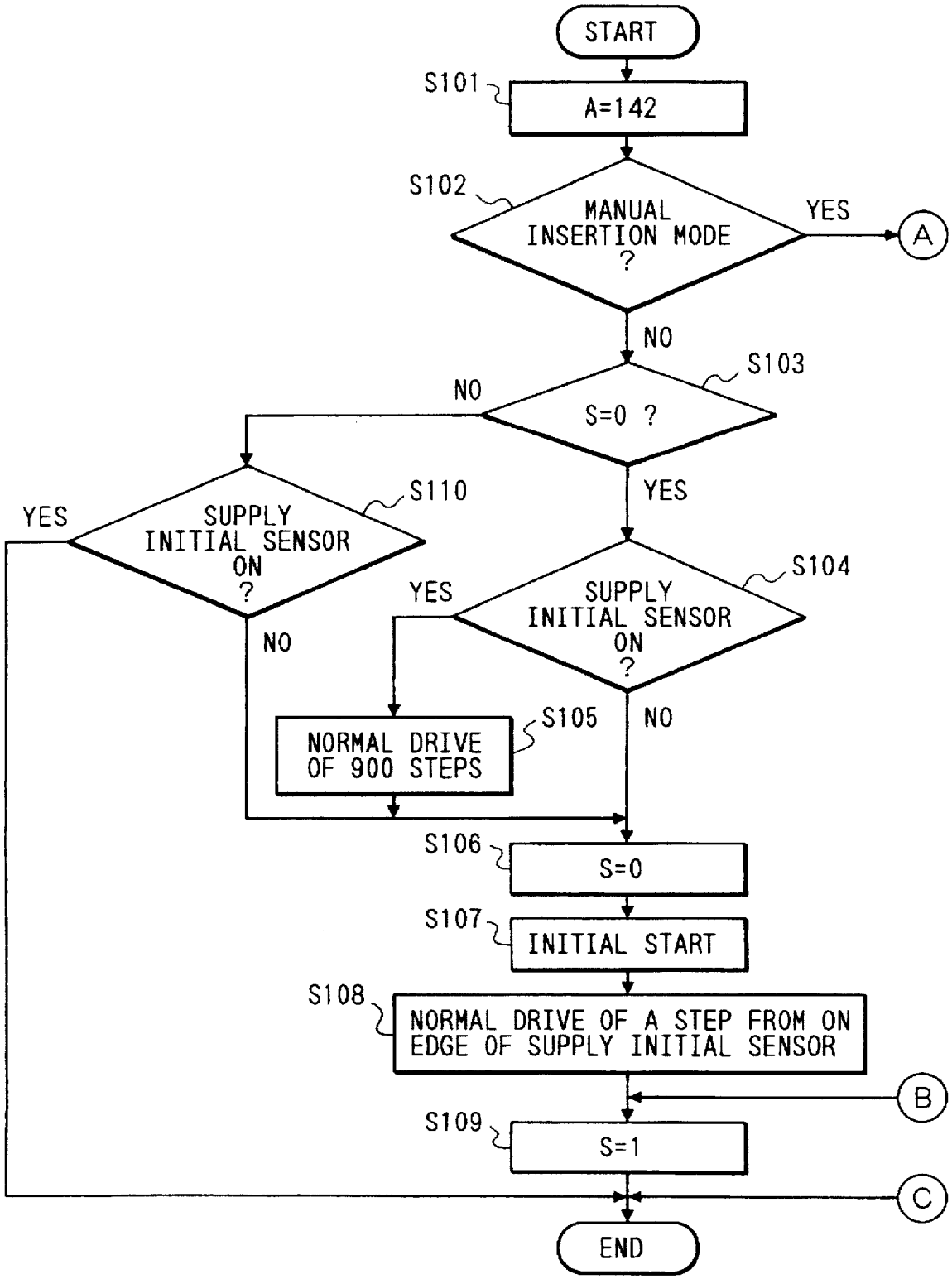
FIG. 13 is comprised of FIGS. 13A and 13B showing flow charts of the initial operation in the sheet feeding apparatus shown in FIG. 4.
Figure 13B:
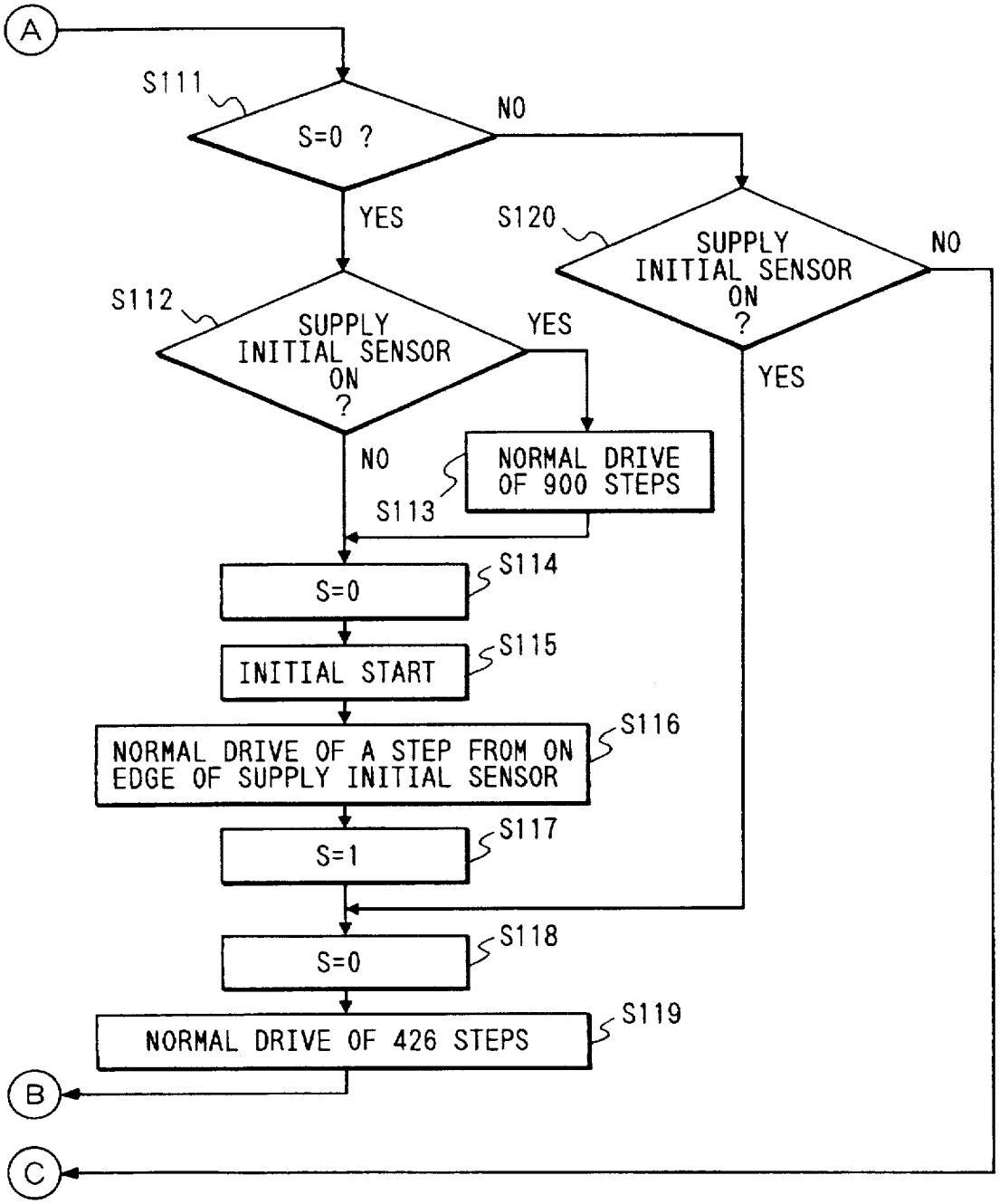

FIGS. 13A and 13B are flow charts illustrating the process of the initial operation of the automatic sheet feeding portion 5 when the power source of a recording apparatus or an information processing apparatus is ON.

When the power source switch changes from its OFF state to its ON state and the initialization of the automatic sheet feeding portion 5 is started, at S101, a value corresponding to 142 steps is set and stored as an initial value in the initial step storing area 2001 in the DRAM. This value is a value for determining by how many steps the automatic sheet supply motor 18 should be driven from the on edge of the sheet supply initial sensor 24.

At the next step S102, whether the mode is the automatic sheet supply mode is or the manual insertion mode is judged. If the sheet supply change switch 25 is OFF and it is judged that the mode is the automatic sheet supply mode, the value of an operation completion flag stored in the operation completion storing area 2004 in the SRAM is examined at the next step S103. When this value is not set (SRAM=0), it shows that the driving of the automatic sheet feeding portion 5 has not been properly completed to the end last time, and when said value is set (SRAM=1), it shows that the driving of the automatic sheet feeding portion 5 has been properly completed to the end last time. Also, design is made such that 0 is set as an initial value.

When at S103, it is judged that SRAM=1 and the driving operation of the automatic sheet feeding portion 5 has been properly completed to the end, whether the sheet supply initial sensor 24 is ON is judged at the next step S110. If at this time, the sheet supply initial sensor 24 is ON, the automatic sheet feeding portion 5 is in the waiting position in the automatic sheet supply state (home position) (FIGS. 9A–9D), and if the sheet supply initial sensor 24 is OFF, the automatic sheet feeding portion 5 is in the waiting position in the manual insertion state (FIGS. 10A–10D). Accordingly, when at S110, it is judged that the sheet supply initial sensor 24 is ON, it follows that the state of the sheet supply change switch 25 is the automatic sheet supply state and the automatic sheet feeding portion 5 is stopped in the automatic sheet supply state waiting position and thus, the initialization of the automatic sheet feeding portion 5 has been completed, and the automatic sheet feeding portion 5 does not operate at all and the process is terminated. Also, when at S110, it is judged that the sheet supply initial sensor 24 is OFF, it means a case where when the power source switch has been changed from its ON position to its OFF position last time, the automatic sheet feeding portion 5 is stopped in the manual insertion state waiting position and before the judgment of S110, the sheet supply change switch 25 has been changed over to the automatic sheet supply state and thus, the driving from the waiting position in the manual insertion state to the waiting position in the automatic sheet supply state is effected.

At S106, the initial operation is started and the driving of the automatic sheet supply motor 18 is effected and therefore, in order to indicate that the separation roller 17, preliminary roller 16 and sheet stopper 15 in the automatic sheet feeding portion 5 are not in the initial completion position, i.e., the home position, 0 is set in the operation completion storing area 2004.

At the next step S107, the driving of the automatic sheet supply motor 18 is started and at the next step S108, the on edge of the sheet supply initial sensor 24 is detected, whereafter the driving of the automatic sheet supply motor 18 is effected by a number of steps corresponding to the value stored in the initial step storing area, whereafter the automatic sheet supply motor 18 is stopped, and shift is made to the next step S109. At S109, in order to indicate that the initial operation has been completed, 1 is set in the operation completion storing area 2004 and thus, the initialization of the automatic sheet feeding portion 5 is completed.

Also, if at S103, it is judged that the initialization is not completed (S=0), shift is made to S104. At S104, whether the sheet supply initial sensor 24 is ON is judged.

If at this time, the sheet supply initial sensor 24 is ON, at S105, the automatic sheet supply motor 18 is driven by 900 steps in order to switch off the sheet supply initial sensor 24, whereafter shift is made to the next step S106. Also, if the sheet supply initial sensor 24 is OFF, shift is directly made to the next step S106. Then, at S106 to S109, control similar to that described above is effected. Also, if it is judged at S102 that the mode is the manual insertion mode, shift is made to S111.

If at S111, SRAM=1 and it is judged that the driving operation of the automatic sheet feeding portion 5 has been properly completed to the end, whether the sheet supply initial sensor 24 is ON is judged at the next step S120. If at S120, it is judged that the sheet supply initial sensor 24 is OFF, it follows that the state of the sheet supply change switch 25 is the manual insertion state and the automatic sheet feeding portion 5 is stopped in the waiting position in the manual insertion state and thus, the initialization of the automatic sheet feeding portion 5 has been completed, and the automatic sheet feeding portion 5 does not operate at all and the process is terminated. Also, if at S120, it is judged that the sheet supply initial sensor 24 is ON, it is a case where when the power source switch has been changed from its ON position to its OFF position last time, the automatic sheet feeding portion 5 is stopped in the waiting position in the automatic sheet supply state and before the judgment of S120, the sheet supply change switch 25 has been changed over to the manual insertion state and thus, the driving from the waiting position in the automatic sheet supply state to the waiting position in the manual insertion state is effected.

At S118, when starting the driving of the automatic sheet supply motor 18 so that the state of the automatic sheet feeding portion 5 may become a position corresponding to the manual insertion mode, 0 is set in the operation completion storing area 2004 as at S106 in order to indicate that the separation roller 17, preliminary roller 16 and sheet stopper 15 in the automatic sheet feeding portion 5 come out of the home position. At the next step S119, the automatic sheet supply motor 18 is driven by 426 steps (corresponding to the rotation of about 30° of the cam gear 22), and the state of each part in the automatic sheet feeding portion 5 is changed to a position corresponding to the manual insertion mode, and at the next step S109, 1 is set in the operation completion storing area 2004 in order to indicate the initial operation has been completed, and the initial operation of the automatic sheet feeding portion 5 is completed.

Also, if at S110, it is judged that the initialization has not been completed, shift is made to S112. Control similar to that of S112 to S117 and S104 to S109 is then effected and shift is made to S118, whereafter control similar to that described above is effected.

Figures 14, 14A:
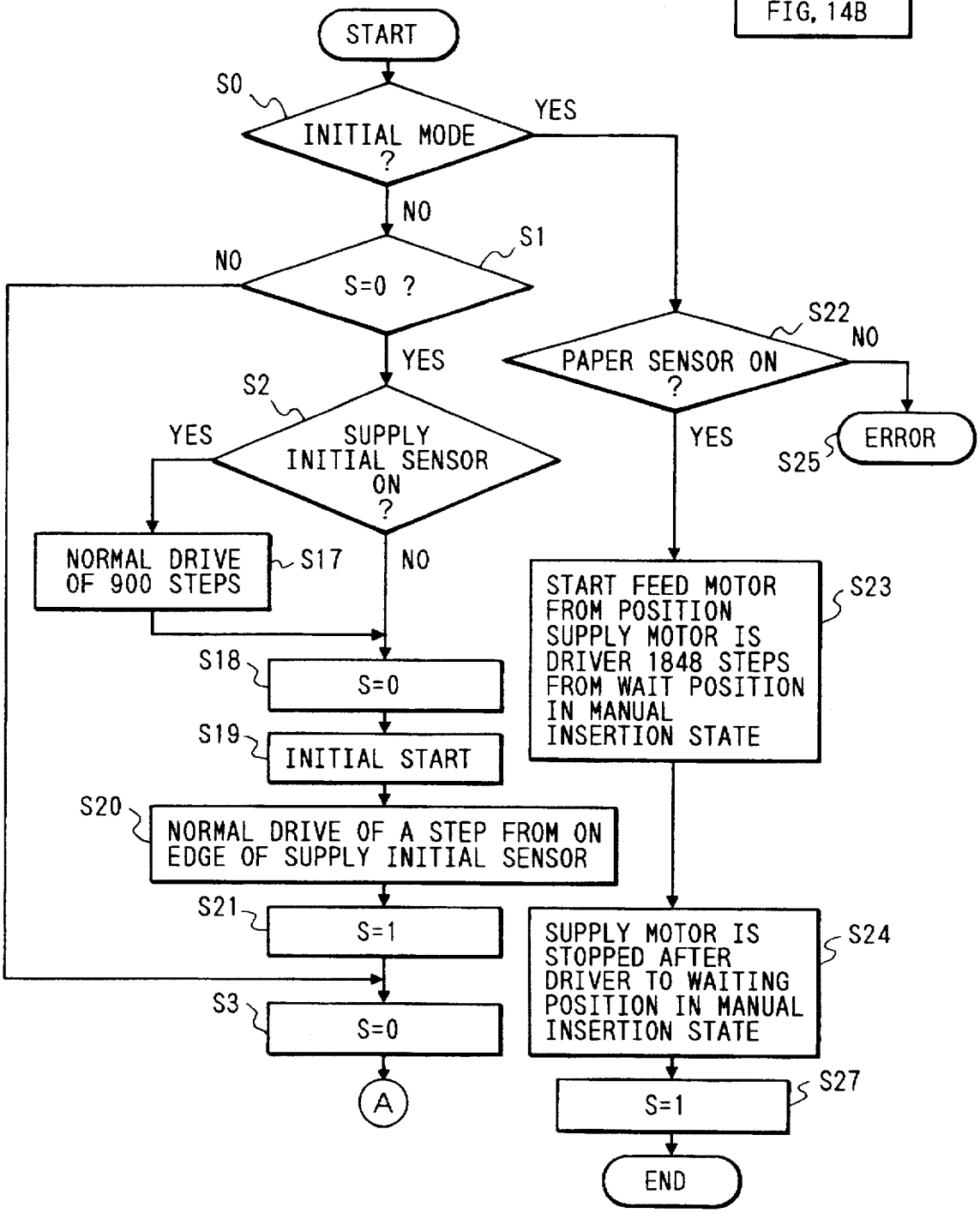
FIG. 14 is comprised of FIGS. 14A and 14B showing flow charts of the sheet feeding operation in the sheet feeding apparatus shown in FIG. 4.
Figure 14B:
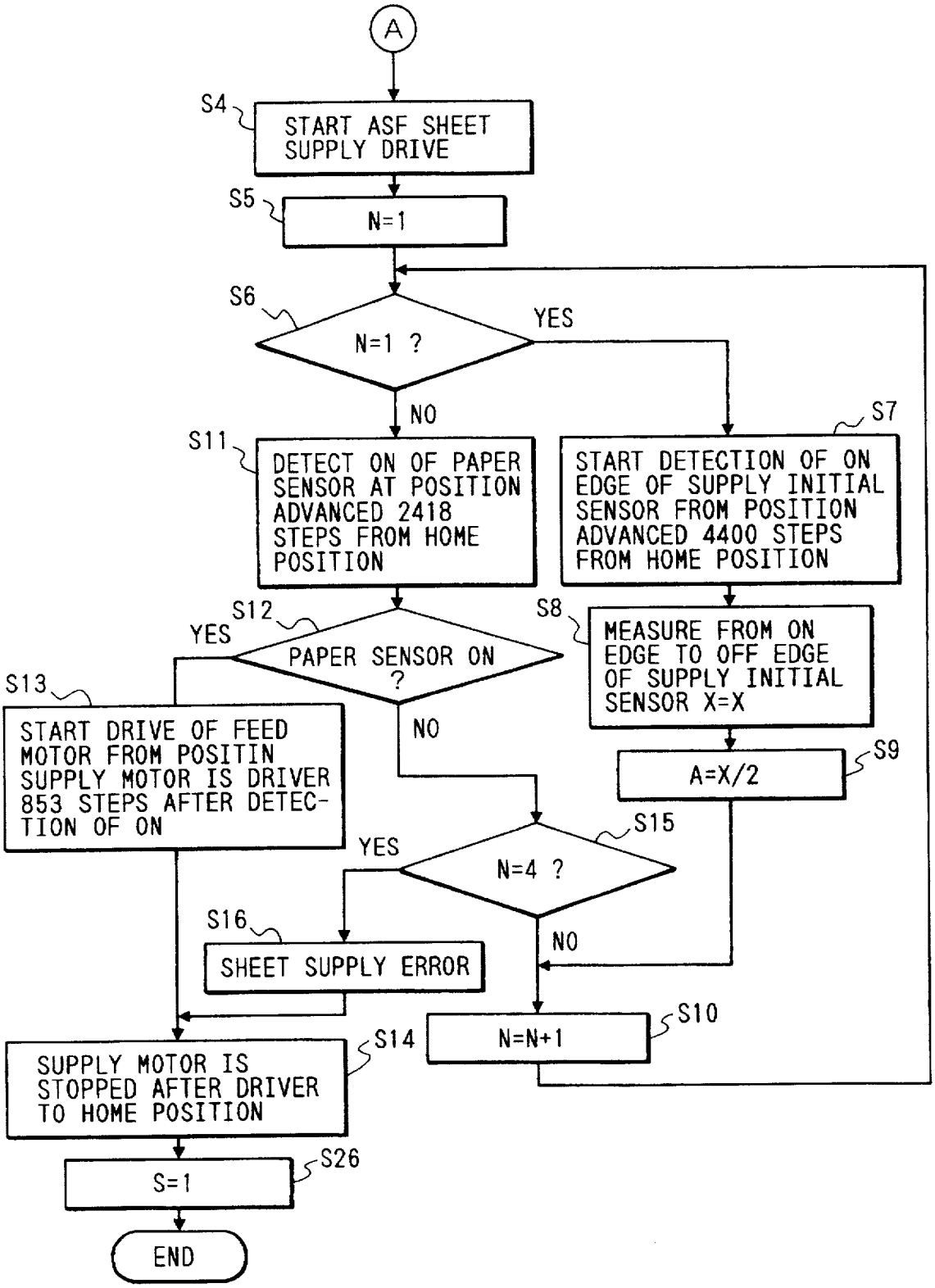

The operational sequence of the automatic sheet feeding portion 5 will now be described with reference to a flow chart shown in FIGS. 14A and 14B. FIGS. 14A and 14B are flow charts illustrating the sheet feeding operation of the automatic sheet feeding portion 5 until the driving operation of the sheet feeding motor 14 is started in the sheet supplying operation of an ink jet printer.

When a sheet supply command for the sheet P is given, at a step S0, the state of the sheet supply change switch 25 is judged and whether the state of the automatic sheet feeding portion 5 is the automatic sheet supply state or the manual insertion sheet supply state is judged. If at this time, it is judged that the sheet supply change switch 25 is in its ON state and the state of the automatic sheet feeding portion 5 is the automatic sheet supply state, shift is made to a step S1. At the step S1, the value of an operation completion flag stored in the operation completion storing area 2004 in the SRAM is examined. If at the step S1, it is judged that SRAM=1 (S=1 in FIG. 14A) and the driving of the automatic sheet feeding portion 5 has been properly completed to the end last time, shift is made to a step S3.

At the step S3, prior to the start of the driving of the automatic sheet supply motor 18, the operation flag stored in the operation completion storing area 2004 in the SRAM is reset (SRAM=0). Shift is then made to a step S4, where the driving of the automatic sheet supply motor 18 is started to thereby start the automatic supply of the sheets P (ASF sheet supply drive starts).

Shift is then made to a step S5, where as an initial value for judging how many full rotations the preliminary roller 16 and separation roller 17 have made since the automatic sheet supplying operation was started, 1 is set in the number of revolutions storing area 2002 in the DRAM (N=1), and subsequently, at a step S6, whether the preliminary roller 16 and separation roller 17 have made the first full rotation since the automatic sheet supplying operation was started is judged.

If at the step S6, it is judged that the rotation of the preliminary roller and separation roller is the first full rotation, shift is made to a step S7, where in order to measure the area in which the sheet supply initial sensor 24 is ON, the detection of the ON edge of the sheet supply initial sensor 24 is started from a position in which the automatic sheet supply motor 18 has been driven by 4400 steps from the waiting position (home position) in the automatic sheet supply state. Shift is then made to a step S8, where the number of steps X by which the automatic sheet supply motor 18 has been driven to detect the ON edge to the OFF edge of the sheet supply initial sensor 24 is measured, and then shift is made to a step S9, where the value of a half of the measured number of steps X (A=X/2) is stored in the initial step storing area 2001 in the DRAM, whereafter shift is made to a step S10.

At the step S10, the value in the number of revolutions storing area 2002 in the DRAM is set to 2 (N=N+1) in order to prepare for the judgment that the driving for the second full rotation of the preliminary roller 16 and separation roller 17 is entered. Return is then made to the step S6, where whether the preliminary roller 16 and separation roller 17 have made the first full rotation since the automatic sheet supply operation was started is judged, but this judgment is one after the process of the step S10 and therefore, it is judged that the rotation of the preliminary roller and separation roller is not the first full rotation, and shift is made to a step S11.

At the step S11, in the driving for the second full rotation of the preliminary roller 16 and separation roller 17, the automatic sheet supply motor 18 is driven by 2418 steps (which is the number from the second full rotation, and summing up from the first full rotation, 5120+2418=7538 steps; in the following description, the number of steps from the waiting position in the automatic sheet supply state will also be described in accordance with the above-mentioned number of steps) from the waiting position in the automatic sheet supply state, whereafter shift is made to a step S12, where the detection of the ON state of the paper sensor E is effected. If at the step S12, it is judged that the paper sensor E is ON, it means that the sheet P is being conveyed, and shift is made to a step S13, where the automatic sheet supply motor 18 is further driven by 853 steps, whereafter the driving of the sheet feeding motor 14 is started to thereby start the conveyance of the sheet P to the recording portion 7 by the pair of conveying rollers 6. Shift is then made to a step S14, where the automatic sheet supply motor 18 is driven from the ON edge of the sheet supply initial sensor 24 to the value stored in the initial step storing area 2001 and is then stopped, and at the next step S26, 1 is set in the operation completion storing area 2004, and the sheet supplying operation is terminated.

Also, if at the step S12, it is judged that the paper sensor E is OFF, shift is made to a step S15, where whether the driving of the preliminary roller 16 and separation roller 17 has been done for four full rotations is judged. At the above-described point of time, the driving is for two full rotations and therefore, shift is made to a step S10, where preparations are made for the judgment that the driving is that for the third full rotation, and return is made to the step S6. At the step S6, whether the preliminary roller 16 and separation roller 17 have made the first full rotation since the automatic sheet supplying operation was started is judged again, but now is the driving for the third full rotation and therefore, it is judged that the rotation is not the first full rotation, and shift is made to a step S11.

At the step S11, in the driving for the third full rotation of the preliminary roller 16 and separation roller 17, the automatic sheet supply motor 18 is driven by 2418 steps from the waiting position in the automatic sheet supply state, whereafter shift is made to the step S12, where the detection of the ON state of the paper sensor E is effected. If at the step S12, it is judged that the paper sensor E is ON, shift is made to the steps S13–S14, where similar control is effected.

Also, if at the step S12, it is judged that the paper sensor E is OFF, shift is made to a step S15, where whether the driving of the preliminary roller 16 and separation roller 17 has been effected for four full rotations is judged. At the above-described point of time, the driving is that for three full rotations and therefore, shift is made to the step S10, where preparations are made for the judgment that the driving is that for the fourth full rotation, and return is made to the step S6. At the step S6, whether the preliminary roller 16 and separation roller 17 have made the first full rotation since the automatic sheet supplying operation was started is judged, but now is the driving for the fourth full rotation and therefore, it is judged that the rotation is not the first full rotation, and shift is made to the step S11.

At the step S11, in the driving for the fourth full rotation of the preliminary roller 16 and separation roller 17, the automatic sheet supply motor 18 is driven by 2418 steps from the waiting position in the automatic sheet supply state, whereafter shift is made to the step S12, where the detection of the ON state of the paper sensor E is effected. If at the step S12, it is judged that the paper sensor E is ON, shift is made to the steps S13–S14, where similar control is effected.

Also, if at the step S12, it is judged that the paper sensor E is OFF, shift is made to a step S15, where whether the driving of the preliminary roller 16 and separation roller 17 has been effected for four full rotations is judged. At the above-described point of time, the driving is that for four full rotations and therefore, even if the preliminary roller 16 and separation roller 17 are driven for four full rotations, the sheet P is not conveyed and the paper sensor E is not turned on and therefore, shift is made to a step S16, where the user is informed of an abnormal state by the display of an error message on a display device or by a buzzer or the like, whereafter shift is made to the step S14, where the automatic sheet supply motor 18 is driven from the ON edge of the sheet supply initial sensor 24 to the value stored in the initial step storing area 2001 and is then stopped, thus terminating the sheet supplying operation.

Also, if at the step S1, it is judged that SRAM=0 and the driving operation of the automatic sheet feeding portion 5 has not been properly completed last time, the initial operation of the automatic sheet feeding portion 5 must first be executed and therefore, shift is made to the step S2, where whether the sheet supply initial sensor 24 is ON is judged. If it is judged that the sheet supply initial sensor 24 is ON, shift is made to a step S17 to change the state of the automatic sheet feeding portion 5 so that the sheet supply initial sensor 24 may once be turned off, and the automatic sheet supply motor 18 is driven by 900 steps, whereafter shift is made to a step S18. Also, if at the step S2, it is judged that the sheet supply initial sensor 24 is OFF, shift is directly made to the step S18.

At the step S18, prior to the driving of the automatic sheet supply motor 18, the operation flag stored in the operation completion storing area 2004 in the SRAM is reset (SRAM=0). Shift is then made to a step S19, where the driving of the automatic sheet supply motor 18 is started (initial start), and then shift is made to a step S20, where the ON edge of the sheet supply initial sensor 24 is detected, whereafter the automatic sheet supply motor 18 is driven from the detected ON edge to the value stored in the initial step storing area 2001 (A step normal driving), whereafter shift is made to a step S21. At this time, the initial operation executed when the power source switch of the ink jet printer 3 is closed (or the value obtained by the control described with respect to the steps S6–S9) is stored in the initial step storing area 2001.

At the step S21, in order to indicate that the initial operation of the automatic sheet feeding portion 5 has been completed, the operation flag in the operation completion storing area 2004 is set (SRAM=1), whereafter shift is made to the step S3, and a control operation similar to that of the step S3 and subsequent steps is performed.

Also, if at the step S0, it is judged that the sheet supply change switch 25 is OFF and the automatic sheet feeding portion 5 is in the manual insertion feeding state, shift is made to a step S22. At the step S22, in order to judge whether the sheet P is set at or near the first set position in which it strikes against the nip portion of the pair of conveying rollers 6, whether the paper sensor E is ON is judged. If it is judged that the paper sensor E is ON, shift is made to a step S23, where the driving of the sheet feeding motor 14 is started from a position in which the automatic sheet supply motor 18 has been driven by 1848 steps from the sheet supply waiting position in the manual insertion sheet supply state, whereby the conveyance of the sheet P to the recording portion 7 by the pair of conveying rollers 6 is started. At this time, 0 is set in the operation completion storing area 2004 before the driving of the automatic sheet supply motor 18 is started. Shift is then made to a step S24, where the automatic sheet supply motor 18 is driven from the ON edge of the sheet supply initial sensor 24 to the position of the value stored in the initial step storing area 2001, plus 426 steps (the waiting position in the manual insertion sheet supply state) and is then stopped, and at the next step S27, 1 is set in the operation completion storing area 2004, thus terminating the sheet supplying operation.

Also, if at the step S22, it is judged that the paper sensor E is OFF, it means that the sheet P is not set at or near the first set position, and shift is made to a step S25, where the user is informed of an abnormal state by the display of an error message on a display device or by a buzzer or the like.

According to the above-described construction, when in the manual insertion sheet supply state, a sheet P such as an envelope or thick paper is to be set at the first set position and be fed, the preliminary roller 16 and separation roller 17 are driven by a predetermined amount to thereby give a propulsive force to the sheet P, and even if the trailing end of the sheet P is not manually held down, unsatisfactory feeding will not occur and the sheet P can be well nipped by the nip portion of the pair of conveying rollers 6. Also, even if the sheet P is not set with its leading end sufficiently knocked against the nip portion of the pair of conveying rollers 6, unsatisfactory feeding will not occur, and the setting of the sheet P will become easy and also a reliable feeding operation can be realized.

[Other Embodiments]

In the above-described first embodiment, when the sheet P is set at the first set position and is to be conveyed therefrom into the recording portion 7, both of the preliminary roller 16 and the separation roller 17 are caused to act on the sheet P to thereby give a propulsive force to the sheet P, but if provision is made of drive sources for driving the preliminary roller 16 and separation roller 17, respectively, such as a preliminary roller motor and a separation roller motor, and if at the step S23 in the flow chart shown in FIG. 14A, for example, the automatic sheet supply motor 18 is changed to the separation roller motor, only the separation roller 17 could be driven to thereby give a propulsive force to the sheet P, thus obtaining a similar effect. In this case, at the step S24, the separation roller motor will be driven to the waiting position in the manual insertion sheet supply state and be stopped there. Also, the other driving of the automatic sheet supply motor 18 will be replaced by the driving of the separation roller motor and preliminary roller motor.

Also, at the step S23 in the flow chart shown in FIG. 14A, the automatic sheet supply motor 18 can be changed to the preliminary roller motor and only the preliminary roller 16 can be driven to thereby give a propulsive force to the sheet P, thus obtaining a similar effect. In this case, at the step S24, the preliminary roller motor will be driven to the waiting position in the manual insertion sheet supply state and be stopped there. Also, the other driving of the automatic sheet supply motor 18 will be replaced by the driving of the separation roller motor and preliminary roller motor.

Further, in each of the above-described embodiments, sections in which the automatic sheet supply motor 18, the separation roller motor, the preliminary roller motor and the sheet feeding motor 14 are driven are not limited to those in the above-described embodiments, but as regards the timing for starting the driving of the sheet feeding motor 14 set at the step S23 in the flow chart of FIG. 14A, the sheet P can be given a propulsive force by one or both of the separation roller 17 and the preliminary roller 16 before the pair of conveying rollers 6 start to be driven, and a similar effect will be obtained even if said timing is freely set within that range.

Also, in each of the aforedescribed embodiments, an ink jet recording system is used as recording means, but it will be more preferable if design is made such that an electro-thermal conversion member is electrically energized in conformity with a recording signal and film boiling created in ink by heat energy applied by the electro-thermal conversion member is utilized to grow and contract bubbles produced in the ink to thereby discharge the ink from discharge ports and effect recording.

This system is applicable to any of the so-called on-demand type and the so-called continuous type, and particularly in the case of the on-demand type, it is effective because at least one driving signal corresponding to recording information and providing a rapid temperature rise exceeding nuclear boiling is applied to an electro-thermal conversion member disposed corresponding to a sheet or a liquid path retaining liquid (ink) therein, whereby heat energy is generated in the electro-thermal conversion member and film boiling is caused on the heat acting surface of a recording head with a result that there can be formed a bubble in the liquid which corresponds at one to one to the driving signal. The liquid is discharged by the growth and contraction of this bubble through a discharge opening to thereby form at least one droplet. If the driving signal is of a pulse shape, the growth and contraction of the bubble will appropriately take place on the spot and especially excellent discharge of the liquid could be accomplished, and this is more preferable.

Further, the present invention can also be applied to a recording head of the full line type having a length corresponding to the maximum width of a recording medium on which a recording apparatus can effect recording. Such a recording head may be of a construction which satisfies the length by a combination of a plurality of recording heads, construction as a single recording head formed as a unit. In addition, even if it is of the aforedescribed serial type, use may be made of a recording head fixed to a carrier, or a recording head of the interchangeable chip type which makes its electrical connection to an apparatus body and the supply of ink from the apparatus body possible by being mounted on a carrier.

Also, it is preferable to add recovery means, preliminary auxiliary means, etc. for the recording head provided as the constituents of the recording apparatus of the present invention, because it can more stabilize the effect of the present invention. Specifically mentioning these, capping means for the recording head, cleaning means, pressing or sucking means, a heating element of the electro-thermal conversion type or discrete therefrom, or preheating means comprising a combination of these, and a preliminary discharge mode in which discharge discrete from that for recording is effected are effective to accomplish stable recording.

Also, with regard to the kind or number of recording heads carried on the carrier, for example, only one recording head may be provided corresponding to ink of a single color, or a plurality of recording heads may be provided correspondingly to a plurality of inks differing in recording color or density from one another. That is, for example, the recording mode of the recording apparatus is not limited to a recording mode of a main current color such as black, but may also be a recording mode using a plurality of recording heads constructed as a unit, and the present invention is also applicable to an apparatus provided with at least either of a plurality of different colors and full color consisting of mixed colors.

Furthermore, in the aforedescribed embodiments, the ink has been described as liquid, but use can be made of any ink which assumes a liquid phase when a recording signal in use is imparted thereto, because it is the usual practice to use ink which solidifies at room temperature or below and which softens or liquefies at room temperature, or in the ink jet recording system, ink which itself is temperature-controlled within a range of 30° C. to 70° C. so that the viscosity of the ink may be within a stable discharge range. In addition, the present invention is also applicable to a case where use is made of ink which solidifies when it is left unused, for the purpose of preventing the temperature rise by heat energy by it being positively used as the energy from the change of the ink from its solid state to its liquid state, or for the purpose of preventing the evaporation of the ink, and anyhow such as ink which is use is made of ink having the nature of being liquefied only by heat energy, such as ink which is liquefied by heat energy being imparted thereto in conformity with a recording signal and is discharged as liquid ink, or ink which already begins to solidify at a point of time whereat it arrives at a recording sheet.

Further, the forms of the aforedescribed ink jet printer may be, besides that used as the image output terminal of an information processing instrument such as a computer, the form of a copying apparatus combined with a reader or the like, and further the form of a facsimile apparatus having the signal transmitting and receiving functions.

While description has been made above with respect to an example in which the ink Jet recording system is used as the recording means, the recording system of the present invention need not be restricted to the ink Jet recording system, but may also be the heat transfer recording system or the thermosensitive recording system, or further any other recording system than the impact recording system such as the wire dot recording system. The present invention need neither be restricted to the serial recording system, but may also use the so-called line recording system.

What is claimed is:

1. A sheet feeding operable in one of a manual mode and an automatic mode, comprising:

common sheet supporting means for supporting a sheet inserted in the manual mode and sheets stacked in the automatic sheet supply mode thereon;

sheet feeding means for feeding out a sheet from the sheets supported on said sheet supporting means;

sheet conveying means disposed downstream of said sheet feeding means for conveying the sheet fed out by said sheet feeding means;

a stopper disposed between said sheet feeding means and said sheet conveying means for regulating the sheets on said sheet supporting means at a regulating position, said stopper retracted from the regulating position in accordance with a sheet feeding action by said sheet feeding means in the automatic sheet supply mode, and being in a retracted position in the manual mode; and control means for controlling said sheet feeding means and said sheet conveying means so that, in the automatic sheet supply mode, the sheet is fed out from said sheet supporting means by said sheet feeding means and then conveyed by said sheet conveying means; and, in the manual mode, the sheet inserted manually to said sheet conveying means is conveyed by said sheet feeding means and said sheet conveying means.

2. A sheet feeding apparatus according to claim 1, wherein during non-feeding said sheet supporting means and said sheet feeding means are spaced apart from each other.

3. A sheet feeding apparatus operable in one of a manual mode and an automatic mode, comprising:

common sheet supporting means for supporting a sheet inserted in the manual mode and sheets stacked in the automatic sheet supply mode thereon;

sheet feeding means for feeding out a sheet from the sheets supported on said sheet supporting means;

sheet conveying means disposed downstream of said sheet feeding means for conveying the sheet fed out by said sheet feeding means;

mode selecting means for selecting the automatic sheet supply mode to supply the sheet from the sheets in said sheet supporting means automatically, and the manual mode to supply a sheet manually inserted to said sheet conveying means;

a stopper disposed between said sheet feeding means and said sheet conveying means for regulating the sheets on said sheet supporting means at a regulating position, said stopper retracted from the regulating position in accordance with a sheet feeding action by said sheet feeding means in the automatic sheet supply mode, and being in a retracted position in the manual mode; and control means for controlling said sheet feeding means and said sheet conveying means so that, in the automatic sheet mode, the sheet is fed out from said sheet supporting means by said sheet feeding means and then conveyed by said sheet conveying means; and, when in the manual mode, the sheet inserted manually to said sheet conveying means is conveyed by said sheet feeding means and said sheet conveying means.

4. A sheet feeding apparatus according to claim 3, wherein said sheet feeding means is provided with a preliminary roller for feeding the sheets supporting on said sheet supporting means, and a separation roller for separating the fed sheets, and has means for spacing said preliminary roller and said separation roller apart from said sheet supporting means.

5. A sheet feeding apparatus according to claim 4, wherein in the manual mode, said preliminary roller and said separation roller are rotated to feed the sheets.

6. A sheet feeding apparatus according to claim 4, wherein in the manual mode, only said separation roller is rotated to feed the sheets.

7. A sheet feeding apparatus according to claim 4, wherein said means for spacing said preliminary roller apart from said sheet supporting means has a cam member for moving up and down said preliminary roller, said cam member being operated by the drive from a drive source for rotating said preliminary roller.

8. A sheet feeding apparatus according to claim 4, wherein a cam member is provided for moving said stopper member, said cam member being operated by the drive from a drive source for rotating said preliminary roller.

9. A recording apparatus operable in one of a manual mode and an automatic mode, comprising:

common sheet supporting means for supporting a sheet inserted in the manual mode and sheets stacked in the automatic sheet supply mode thereon;

sheet feeding means for feeding out a sheet from the sheets supported on said sheet supporting means;

sheet conveying means disposed downstream of said sheet feeding means for conveying the sheet fed out by said sheet feeding means;

a stopper disposed between said sheet feeding means and said sheet conveying means for regulating the sheets on said sheet supporting means at a regulating position, said stopper retracted from the regulating position in accordance with a sheet feeding action by said sheet feeding means in the automatic sheet supply mode, and being in a retracted position in the manual mode; and control means for controlling said sheet feeding means and said sheet conveying means so that, in the automatic sheet supply mode, the sheet is fed out from said sheet supporting means by said sheet feeding means and then conveyed by said sheet conveying means; and, in the manual mode, the sheet inserted manually to said sheet conveying means is conveyed by said sheet feeding means and said sheet conveying means; and recording means for effecting recording on the sheet fed by each of said modes.

10. A recording apparatus operable in one of a manual mode and an automatic mode, comprising:

common sheet supporting means for supporting a sheet inserted in the manual mode and sheets stacked in the automatic sheet supply mode thereon;

sheet feeding means for feeding out a sheet from the sheets supported on said sheet supporting means;

sheet conveying means disposed downstream of said sheet feeding means for conveying the sheet fed out by said sheet feeding means;

mode selecting means for selecting the automatic sheet supply mode to supply the sheet in said sheet supporting means automatically, and the manual mode to supply the sheet manually inserted to said sheet conveying means;

a stopper disposed between said sheet feeding means and said sheet conveying means for regulating the sheets on said sheet supporting means at a regulating position, said stopper retracted from the regulating position in accordance with a sheet feeding action by said sheet feeding means in the automatic sheet supply mode, and being in a retracted position in the manual mode; and control means for controlling said sheet feeding means and said sheet conveying means so that, in the automatic sheet mode, the sheet is fed out from said sheet supporting means by said sheet feeding means and then conveyed by said sheet conveying means; and, when the manual mode, the sheet inserted manually to said sheet conveying means is conveyed by said sheet feeding means and said sheet conveying means; and recording means for effecting recording on the sheets fed in each of said modes.

* * * * *

UNITED STATES PATENT AND TRADEMARK OFFICE

CERTIFICATE OF CORRECTION

PATENT NO. : 5,725,206
DATED : March 10, 1998
INVENTOR(S) : Noriyuki SUGIYAMA

It is certified that error appears in the above-identified patent and that said Letters Patent is hereby corrected as shown below:

Column 2, line 47, after "diagrams", insert --of--;
Line 67, delete "suck" and insert therefor --such--.

Column 6, line 1, delete "Mount" and insert therefor --amount--;
Line 31, delete "an" and insert therefor --as-- and after "by", insert --the--.

Column 7, line 25, delete "an" and insert therefor --a--;
Line 43, delete "an" and insert therefor --a--.

Column 12, line 2, delete "once" and insert therefor --first--.

Column 14, line 1, delete "at";
Line 13, after "heads,", insert --or a--.

Column 15, lines 8 and 10, delete "Jet", both occurrences, and insert therefor --jet--.

Column 16, line 12, delete "supporting" and insert therefor --supported--.

Column 18, line 7, after"when", insert --in--.

Signed and Sealed this

First Day of September, 1998

Bruce Lehman

*Attest:*

BRUCE LEHMAN

*Attesting Officer*

*Commissioner of Patents and Trademarks*